US005635668A

United States Patent [19]

Barnes et al.

[11] Patent Number: 5,635,668

[45] Date of Patent: Jun. 3, 1997

[54] GAS GENERANT COMPOSITIONS CONTAINING COPPER NITRATE COMPLEXES

[75] Inventors: Michael W. Barnes, Brigham City; Robert D. Taylor, Hyrum; Christopher Hock, Uintah, all of Utah

[73] Assignee: Morton International, Inc., Chicago, Ill.

[21] Appl. No.: 616,606

[22] Filed: Mar. 15, 1996

[51] Int. Cl.[6] ..... C06B 31/00

[52] U.S. Cl. ..... 149/45; 149/92

[58] Field of Search ..... 149/45, 92

[56] References Cited

U.S. PATENT DOCUMENTS

| | | | |
|---|---|---|---|
| 3,335,491 | 11/1967 | Niles et al. | 260/564 |
| 4,274,893 | 6/1981 | Mars et al. | 149/2 |
| 4,336,085 | 6/1982 | Walker | 149/45 |
| 4,369,079 | 1/1983 | Shaw | 149/2 |
| 4,370,181 | 1/1983 | Lundstrom et al. | 149/2 |
| 5,014,623 | 5/1991 | Walker et al. | 102/477 |
| 5,197,758 | 3/1993 | Lund et al. | 280/741 |
| 5,431,103 | 7/1995 | Hock et al. | 102/287 |
| 5,592,812 | 1/1997 | Hinshaw et al. | 149/45 X |

FOREIGN PATENT DOCUMENTS

| | | |
|---|---|---|
| 9509825 | 4/1995 | WIPO . |

*Primary Examiner*—Peter A. Nelson

*Attorney, Agent, or Firm*—Wayne E. Nacker; Gerald K. White

[57] ABSTRACT

Gas generant compositions utilize cupric nitrate complexes of nitrogen-containing compounds as fuels in conjunction with an oxidizer.

4 Claims, No Drawings

GAS GENERANT COMPOSITIONS CONTAINING COPPER NITRATE COMPLEXES

The present invention is directed to gas generant compositions, such as those used to inflate automotive airbags, and particularly to gas generant compositions using copper nitrate complexes as fuel.

BACKGROUND OF THE INVENTION

Gas generant compositions for inflating automotive airbags are most commonly based on sodium azide, which, on inflation, produces nitrogen gas. However, due to toxicity and stability problems, there is a significant movement away from sodium azide as a fuel, and a number of non-azide gas generant formulations have been proposed, e.g., U.S. Pat. Nos. 4,369,079, 4,370,181, 5,197,758, and 5,431,103, the teachings of each of which are incorporated herein by reference. Non-azide formulations, however, tend to present their own problems, such as generation of particulates and generation of noxious gases. Thus, there remains a need for safe, effective gas generants for inflating automotive airbags and the like.

It has been thought to use ammonia ligands of cupric nitrate, i.e., $Cu(NH_3)_4(NO_3)_2$ and $Cu(NH_3)_2(NO_3)_2$ as fuels in gas generants. However, the first (four ammonia ligands) has proven to be unstable. The second (two ammonia ligands) is a stable compound, but proves to be hydrolytically unstable, i.e., adsorbs atmospheric water, a characteristic highly undesirable in a gas generant composition.

SUMMARY OF THE INVENTION

In accordance with the present invention there is provided a gas generant composition comprising between about 30 and about 60 wt. % of A) a fuel, and between about 40 and about 70 wt % of B) oxidizer based on total weight of A) plus B); at least about 60 wt %, up to 100 wt % of the fuel A) comprises a cupric nitrate ligand of the formula: $Cu(L)_2(NO_3)_2$; where L is a ligand selected from the group consisting of ethylenediamine, biuret, ethanolamine, and mixtures thereof. The nitrate group of these complexes functions as an internal oxidizer; thus requiring a relatively small amount of external oxidizer. Accordingly, gas generant formulations based on these copper complexes generate large volumes of gas per weight of fuel.

DETAILED DESCRIPTION OF CERTAIN PREFERRED EMBODIMENTS

The primary fuels of the gas generant compositions of the present invention, cupric nitrate ligands, are easily prepared from cupric nitrate and the ligand compound. Preparation of such cupric nitrate complexes are described, for example, in Gmelin, *Handbuch der Inorganischen Chemie*, system No. 60, Kupfer, pp. 1472–1491, and W. Engel, *Explosivstoff* (1973, 10, 21(1), pp. 9–13.

While the cupric nitrate complex is the primary fuel, i.e., is at least about 60 wt % of the fuel component A), this fuel can be used in conjunction with up to about 40 wt % (of the fuel component A)) of another fuel, such as nitrate salts of amines, specifically nitrate salts of amines having the formulae:

(I) $(NHZ)_2$—C=O, (II) $(NHZ)_2$—C=NZ, (III) HN—$(CO—NHZ)_2$, (IV) $C_2$–$C_3$–alkyldiamine, and $C_2$–$C_3$-alkanolamine where the Zs are the same or different and are selected from H and $NH_2$ .

In general, the preferred ligands have high oxygen content. Higher ligand oxygen content results in a higher gas yield in a stoichiometrically oxidized composition. As an example, when oxidized with cupric oxide, the gas yields for copper(II) bis-ethylenediamine dinitrate, copper(II) bis-ethanolamine dinitrate, and copper(II) bis-biuret dinitrate are 1.36 moles/100 grams, 1.50 moles/100 grams, and 2.06 moles/100 grams, respectively. The increased gas yields are correlatable with increased oxygen content in the ligand.

The oxidizer component B) is selected from oxidizers known in the art, such as alkali metal and alkaline earth metal nitrates, chlorates and perchlorates, as well as transition metal oxides, such as cupric oxide and iron oxide, and mixtures of such oxidizers. Preferred oxidizers in accordance with the invention are strontium nitrate, cupric oxide, and mixtures thereof.

In addition to the fuel A) and oxidizer B) components, the gas generant compositions of the present invention may further contain additional components, such as pressing aids, lubricants, coolants, etc., as is known in the art, up to about 10 wt % based on total weight of fuel A) plus oxidizer B) calculated as 100 wt %.

The gas generant compositions have a number of advantages, including high gas yield, moderate combustion temperatures, components that are readily available or easily synthesized, thermally stable, non-explosive, and non-toxic. The copper of the cupric nitrate complex becomes easily filtered metallic copper upon combustion, and in conjunction with an appropriate oxidizer, produces a readily filterable slag.

The invention will now be described in greater detail by way of specific examples.

EXAMPLE 1

Synthesis of cupric bis-ethylenediamine dinitrate $(Cu(en)_2(NO_3)_2)$

Cupric nitrate hemipentahydrate (500 gm.; 2.5 mole) was dissolved in one liter water. Ethylenediamine (250 gm.; 4.16 mole) was added to this solution slowly in a dropwise fashion. After the addition was complete, the solution was stirred for 1 hour. It was then concentrated under a stream of air to approximately 800 ml. Approximately 4 liters of acetone were added. The slurry was filtered and the filtrate washed with approximately 300 ml. acetone. The shiny, purple, crystalline solid was dried in a vacuum oven at ambient temperature for several hours and then at 60° C. for 2 hours to yield 454 gm (85% yield) of product. Carbon, hydrogen, nitrogen analysis indicated a reasonably pure product (Found=C, 16.01%; H, 5.23%; N, 28.54%. Theoretical=C, 15.61%; H, 5.24%; N, 27.31%.).

EXAMPLE 2

A gas generant composition was formulated as follows: Cupric bis-ethylenediamine nitrate 29.35 wt %, cupric oxide 60.65 wt %, and strontium nitrate 10 wt %. A reaction vessel was charged with an appropriate amount of water to make a 30% slurry. The solid ingredients were added and the slurry mixed using a high shear mixer. The slurry was poured into a tray and dried in an oven at 85° C. to 105° C. until the mixture could be and was pressed through a 6 mesh screen; drying was then completed.

EXAMPLE 3

A gas generant composition was formulated with cupric bis-ethylenediamine nitrate—35.45 wt % as the fuel and basic copper nitrate $(Cu(NO_3)_2 \cdot 3Cu(OH)_2)$—64.55 wt % as the oxidizer. To a mixture of the solids was added water to form a 10% slurry. The slurry was mixed in a Hobart® mixer and then extruded and spheronized using a Nica® extruder/spheronizer. The prills thus obtained were dried on a fluid bed drier.

EXAMPLE 4

A gas generant composition formulated with cupric bis-ethylenediamine nitrate (57.92 wt %) and strontium nitrate (42.08 wt %) has the following characteristics: gas yield—2.33 M/100 g; combustion temperature—2558° K.; and good slag formation.

What is claimed is:

1. A gas generant composition comprising

A) between about 30 and about 60 wt % of a fuel component, at least about 60 wt % of said fuel component comprising a cupric nitrate ligand of the formula: $Cu(L)_2(NO_3)_2$; where L is a ligand selected from the group consisting of ethylenediamine, biuret, ethanol amine, and mixtures thereof, and B) between about 40 and about 70 wt % of an oxidizer component, said weight percentages of A) and B) being calculated relative to the total of A) and B) equalling 100 wt %.

2. A gas generant composition in accordance with claim 1 wherein L is ethylenediamine.

3. A gas generant composition in accordance with claim 1 wherein L is ethanolamine.

4. A gas generant composition in accordance with claim 1 wherein L is biuret.

* * * * *